United States Patent [19]

Baker

[11] Patent Number: 4,542,544

[45] Date of Patent: Sep. 24, 1985

[54] MODULAR WELDED PERIMETER SKIMMING GUTTER FOR SWIMMING POOLS

[76] Inventor: William H. Baker, 30 Honeysuckle Woods, Clover, S.C. 29710

[21] Appl. No.: 440,105

[22] Filed: Nov. 8, 1982

[51] Int. Cl.[4] ..... E02B 7/00; E04H 3/18

[52] U.S. Cl. ..... 4/510; 4/507; 4/508; 4/506

[58] Field of Search ..... 4/510–512

[56] References Cited

U.S. PATENT DOCUMENTS

| | | | |
|---|---|---|---|
| 3,319,264 | 5/1967 | Scarano | 4/512 |
| 3,668,714 | 6/1972 | Baker | 4/510 |
| 4,059,856 | 11/1977 | Patterson | 4/510 X |

*Primary Examiner*—Henry K. Artis

[57] ABSTRACT

A modular bonded perimeter skimming gutter retaining wall for swimming pools is provided for construction by simple bonding together of a plurality of modular units on-site, disposed about the perimeter of a swimming pool as the retaining wall of the swimming pool, defining a pool-side wall of an open gutter conduit adapted to carry water at a level below a predetermined level of water in the swimming pool, over the top of which wall water may flow from the pool into the gutter, the retaining wall comprising two generally U-shaped channels open along one side and having open interiors defined by side walls extending from a common base, the channels being arranged with the open sides facing one another and bonded together along the end faces of the side walls to a common divider plate closing off each channel and the interior spaces thereof, thereby forming separated conduits of each channel, one of said conduits being adapted to carry clean water feed to the pool and the other of said conduits being adapted to carry gutter water away from the pool.

22 Claims, 5 Drawing Figures

MODULAR WELDED PERIMETER SKIMMING GUTTER FOR SWIMMING POOLS

The gutter system of a swimming pool is one of its most important components, and its design is determinative of many of the characteristics of the pool. However, what constitutes good gutter design has long been a perplexing problem in much dispute. What is recognized is that a swimming pool gutter system must provide an adequate surge flow capacity, especially when the pool is filled with swimmers, and it should not flood when a large group of swimmers enters the pool all at once. It should also provide a good surge- and wave-quelling capacity. Its ability to cope with surges and waves produced by swimmers is quite important to the competitive qualities of the swimming pool.

A problem related to gutter design is the removal of surface dirt. Some types of gutters are designed to provide a skimming action, but it has generally been conceded that the most efficient type of skimming action is provided by the scum gutter type of pool, and on all pools over 1,600 square feet in area, scum gutters are provided as a matter of course. In fact, in some states, surface skimmers are not permitted.

One type of swimming pool with a perimeter gutter provides for flow of water over the top of the gutter wall into the gutter trough at all times. Such a gutter system is described in U.S. Pat. No. 2,932,397 to Ogden dated Apr. 12, 1960. Another and older design appears in U.S. Pat. No. 1,797,397 to Booraem dated Mar. 24, 1931. Such a gutter provides a most efficient skimming action under normal flow conditions, but as soon as swimmers enter the pool, or a heavy surge or wave action is encountered, the additional flow of water over the top of the gutter tends to flood the gutter, after which skimming action is lost until the water can be drained away, and in fact some of the dirt already in the gutter may be washed back.

In an attempt to alleviate such a condition, a modification of the Ogden gutter has been proposed in U.S. Pat. No. 3,363,767 to Ellis dated Jan. 16, 1968, incorporating a plurality of skimmer openings spaced around the gutter at a lower level than the top of the gutter. In this system, when the pool is not in use, the skimmer weir is opened and skimming is obtained via the openings into the gutter (column 2, lines 19 to 24). When the pool is in use, the skimmer weirs are closed (column 2, lines 12 to 13), but the water level is held down below the lip of the gutter, providing a certain in-pool surge capacity, and avoiding a flooded gutter condition at the time of flow surges. However, when the pool is in heavy use and there is considerable wave or surge action over the top of the gutter, surface contaminants washed into the gutter may still be washed back into the pool.

U.S. Pat. Nos. 3,668,712 and 3,668,714, patented June 13, 1972 to Baker, provide perimeter skimming gutters for swimming pools which can permit an adequate skimming action at all times, and provide an adequate surge capacity when the pool is in use, without the possibility of the gutter's flooding or dirt in the gutter's being washed back into the pool.

This is accomplished in No. 3,668,712 by combining a plurality of narrow, elongated, substantially horizontally disposed openings which are open at all times in a retaining wall disposed about the perimeter of the swimming pool, with the peripheral gutter conduit arranged to receive water spilling over the top of the retaining wall when the flow capacity of the elongated openings is exceeded. The elongated openings can be arranged to feed water into the main gutter conduit, or into a separate second gutter conduit, so as to keep these two water flows completely separate, and retain the dirt skimmed off the top of the pool in a separate place, to avoid the hazard of this dirt's being washed back into the pool, in the unlikely event of the first gutter conduit's being flooded during wave actions or surges. In this gutter system, the water level in the pool is normally maintained at the level of the skimmer openings in the gutter.

In No. 3,668,714, the perimeter skimming gutter comprises a first gutter conduit for disposition about the perimeter of a swimming pool, and adapted to carry water at a level below a predetermined level of water in the skimming pool; a retaining wall on the pool-side of the first gutter conduit, over the top of which wall water may flow from the pool into the first gutter conduit; and a second gutter conduit in fluid flow connection with the first, such fluid flow connection entering the first gutter conduit at a level below the top of the retaining wall, and adapted to drain off water from the first gutter conduit at any level exceeding a predetermined maximum level therein, so as to inhibit the level of water in the first gutter conduit from reaching the top of the retaining wall.

U.S. Pat. No. 3,668,713, patented June 13, 1972 to Baker, provides a fluid flow and/or fluid pressure responsive gate weir for swimming pools, comprising in combination, a weir support; a fluid flow passage in the support; a gate member pivotably mounted in the support across the passage between flow-open and flow-closed positions; a gate control means disposed to encounter a fluid flow through and/or fluid pressure in the passage above a predetermined minimum, and responsive to such flow and/or pressure to pivot the gate member from a flow-open towards a flow-closed position; and means arranged to retain the gate member in the flow-open position under normal conditions of fluid flow and/or fluid pressure through the weir passage and to permit pivotal movement of the gate members towards a flow-closed position while such excessive fluid flow and/or fluid pressure continues.

Means can also be provided to return the gate member to the flow-open position when such excessive flow and/or pressure subsides, and/or returns to normal.

U.S. Pat. No. 3,815,160, patented June 11, 1974, to Baker, provides a nonflooding perimeter skimming gutter wall for swimming pools, including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit within a peripheral wall below the first gutter conduit and adapted to carry water at a level above a predetermined level of water in the first gutter conduit, and a fluid flow connection between the two gutter conduits at such level and below the top of the retaining wall allowing water to flow from the first gutter conduit into the second gutter conduit whenever the water level on the first gutter conduit reaches the fluid flow connection, thereby inhibiting filling of the first gutter conduit appreciably above such level.

In the twin gutter structures provided in these patents, the two gutters are separate, and of fixed dimensions. While the gutters can be introduced at a number of locations, flow therebetween is normally not possible until one or the other reaches a predetermined overlow level. This is highly desirable in most circumstances, but on occasion a single gutter of large capacity may be preferred. In a fixed-in-place structure of the type described, this is not possible to achieve.

In accordance with U.S. Pat. No. 4,050,104 patented Sept. 27, 1977, to Baker, a twin gutter system is provided in which the twin gutters can be kept separate or combined in one, as desired, by forming the two gutters with at least one common wall, of which at least a portion thereof can be removed. This feature can be applied in any of the twin gutter systems of U.S. Pat. Nos. 3,688,712, 3,668,713, 3,668,714, and 3,815,160, with or without a skimming function, as desired. The common wall can be all or part of a side wall, an end wall, a bottom wall, or a corner wall, of the gutters, as is illustrated in the drawings, which show preferred structural embodiments.

Thus, a perimeter gutter for swimming pools is provided comprising, in combination, first and second gutter conduits for disposition about the perimeter of a swimming pool, of which conduits at least one is adapted to carry water at a level below a predetermined level of water in the swimming pool; a retaining wall on the pool-side of the gutter conduits, over the top of which wall water may flow from the pool into one of the gutter conduits; the first and second gutter conduits having at least one common wall therebetween, separating interior space of the second gutter conduit from interior space of the first gutter conduit, of which common wall at least a portion is removable, so that upon removal of the wall, said interior spaces are combined and form a gutter whose interior space is greater than the interior space of either gutter conduit.

The first and second gutter conduits can be in fluid flow communication either with the swimming pool or with each other, or with both.

The perimeter gutter structures of all of these patents is rather complex, and not susceptible of manufacture except at a highly sophisticated manufacturing facility. The gutters are best made as a plurality of units that are welded together on-site according to the pool size and shape required. The large number of exterior and interior walls that have to be welded together in leak-tight seals is formidable, and where these walls come together adjacent multiple joints are required that have to be introduced one at a time, which poses a formidable problem upon introduction of the second weld, so as to avoid opening up of the first weld in the process, besides taking considerable labor time on the part of highly skilled welders. This welding problem is especially severe in assembling the retaining wall, which usually requires installing several modular wall units, one on top of the other, in perfect alignment vertically and horizontally, from one modular unit to the next.

The present invention provdes a simplified pool-side retaining wall structure in which at the junction of three walls the walls can all be welded together simultaneously in one weld. The finished retaining wall comprises two conduits in alignment vertically, horizontally, or at any angle thereto, separated by and welded to a common divider wall, in single welds at each end of the divider wall. One side of the retaining wall forms a side retaining wall of the pool, and the other side forms the side wall of a gutter trough.

The modular bonded perimeter skimming gutter retaining wall for swimming pools according to the invention thus is especially designed for construction by simple bonding together of a plurality of modular units on-site, disposed about the perimeter of a swimming pool, as the retaining wall of the swimming pool, defining a pool-side wall of an open gutter conduit adapted to carry water at a level below a predetermined level of water in the swimming pool, over the top of which wall water may flow from the pool into the gutter, the retaining wall comprising two generally U-shaped channels open along one side and having open interiors defined by side walls extending from a common base, the channels being arranged with the open sides facing one another and bonded together along the end faces of the side walls to a common divider plate closing off each channel and the interior spaces thereof, thereby forming separated conduits of each channel, one of said conduits being adapted to carry clean water feed to the pool and the other of said conduits being adapted to carry gutter water away from the pool.

The retaining wall is adapted for combination with a pool-side concrete or other built-in gutter structure at the perimeter of a swimming pool, or with a sheet of material shaped to form and complete the perimeter gutter structure and, in addition, if desired, the top coping of the swimming pool, so as to form a perimeter skimming gutter.

According to one embodiment, the perimeter skimming gutter for swimming pools provided in accordance with the invention comprises, in combination, a first gutter conduit for disposition about the perimeter of a swimming pool, and adapted to carry water at a level below a predetermined level of water in the swimming pool; a retaining wall on the pool-side of the first gutter conduit, over the top of which wall water may flow from the pool into the first gutter conduit; the retaining wall comprising two generally U-shaped upper and lower channels open along one side and having open interiors defined by side walls extending from a common base, the channels being arranged in alignment, with the open sides facing one another, and welded together along the end faces of the side walls to a common divider plate closing off each channel and the interior spaces thereof, thereby forming separated upper and lower conduits of each channel, the upper conduit being adapted to carry clean water feed to the pool and the lower conduit constituting a second gutter adapted to carry gutter water away from the pool, and in fluid flow communication either with the swimming pool or with the first gutter conduit, such fluid flow communication being at a level below the top of the retaining wall.

This twin gutter system can be provided with any desired skimming function.

In another embodiment, the perimeter skimming gutter for swimming pools provided in accordance with the invention comprises in combination, a first gutter conduit for disposition about the perimeter of a swimming pool and adapted to carry water at a level below a predetermined level of water in the swimming pool; a retaining wall on the pool-side of the gutter conduit, over the top of which wall water may flow from the pool into the first gutter conduit, the retaining wall comprising two generally U-shaped upper and lower channels open along one side and having open interiors defined by side walls extending from a common base, the channels being arranged in alignment, with the open sides facing one another, and welded together along the end faces of the side walls to a common divider plate closing off each channel and the interior spaces thereof, thereby forming separated upper and lower conduits of each channel, the upper conduit being adapted to carry clean water feed to the pool and the lower conduit constituting a second gutter adapted to carry gutter water away from the pool, in fluid flow communication either with the swimming pool or with the first gutter conduit, such fluid flow communication being at a level below the top of the retaining wall; the top of the wall being spaced at a height to retain the pool water within the pool perimeter at water flows, wave actions and surges up to a predetermined maximum, while allowing excessive water flows, wave actions and surges beyond such maximum to flow over the top of the wall into the first gutter conduit; the first gutter conduit being removable, and at least one wall thereof being a wall of the second gutter conduit separating interior space of the second gutter conduit from interior space of the first gutter conduit, so that upon removal of the first gutter conduit, said interior spaces are combined and become interior space of the second gutter conduit, forming one gutter whose interior space is greater than the interior space of the second gutter conduit.

According to another embodiment, the perimeter skimming gutter for swimming pools provided in accordance with the invention comprises, in combination, a first gutter conduit for disposition about the perimeter of a swimming pool, and adapted to carry water at a level below a predetermined level of water in the swimming pool; a retaining wall on the pool-side of the first gutter conduit, over the top of which wall water may flow from the pool into the first gutter conduit; the retaining wall comprising two generally U-shaped upper and lower channels open along one side and having open interiors defined by side walls extending from a common base, the channels being arranged in alignment with the open sides facing one another and welded together along the end faces of the side walls to a common divider plate closing off each channel and the interior spaces thereof, thereby forming separated upper and lower conduits of each channel, the upper conduit being adapted to carry clean water feed to the pool and the lower conduit constituting a second gutter adapted to carry gutter water away from the pool, and in fluid flow communication with the first gutter conduit, such fluid flow communication entering the first gutter conduit at a level below the top of the retaining wall, and adapted to drain off water from the first gutter conduit into the second gutter conduit at any level exceeding a predetermined maximum level therein, so as to inhibit and preferably prevent the level of water in the first gutter conduit from ever reaching the top of the retaining wall.

In another embodiment, the perimeter skimming gutter for swimming pools in accordance with the invention comprises, in combination, a first gutter trough for disposition about the perimeter of a swimming pool, and adapted to carry water at a level below a predetermined level of water in the swimming pool; a retaining wall on the pool-side of the trough, over the top of which wall water may flow from the pool into the gutter trough; the retaining wall comprising two generally U-shaped upper and lower channels open along one side and having open interiors defined by side walls extending from a common base, the channels being arranged in alignment with the open sides facing one another and welded together along the end faces of the side walls to a common divider plate closing off each channel and the interior spaces thereof, thereby forming separated upper and lower conduits of each channel, the upper conduit being adapted to carry clean water feed to the pool and the lower conduit constituting a second gutter adapted to carry gutter water away from the pool, and in fluid flow communication either with the swimming pool or with the first gutter conduit, said fluid flow communication being at a level below the top of the retaining wall; and a weir closure member disposed through the retaining wall below the top thereof, at a height to maintain a predetermined water level in the pool, and to provide a skimming flow of water through the weir passage at such predetermined water flow from the pool, the top of the wall being spaced above the weir at a height to retain the pool water within the pool perimeter when the weir is closed at water flows, wave actions, and surges up to a predetermined minimum, while allow excessive flows, wave actions, and surges beyond such minimum to flow over the top of the wall into the gutter trough, the weir comprising a weir support; a fluid flow passage; a weir closure member mount in the support across the passage to move between flow-open and flow-closed positions, and a weir closure control responsive to fluid level and/or fluid flow and/or fluid pressure and which in the flow-open position is disposed to encounter a fluid level and/or fluid flow and/or fluid pressure through the passage above a predetermined minimum, and responds to the motive force applied by such fluid level and/or fluid flow and/or pressure to move the member from the flow-open position towards a flow-closed position.

Another embodiment of the invention is a nonflooding perimeter skimming gutter wall for swimming pools, including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, the retaining wall comprising two generally U-shaped upper and lower channels open along one side and having open interiors defined by side walls extending from a common base, the channels being arranged in alignment, with the open sides facing one another, and welded together along the end faces of the side walls to a common divider plate closing off each channel and the interior spaces thereof, thereby forming separated upper and lower conduits of each channel, the upper conduit being adapted to carry clean water feed to the pool and the lower conduits constituting a second gutter adapted to carry gutter water away from the pool, the second gutter conduit having peripheral wall below the first gutter conduit and adapted to receive water at a level above the predetermined level of water in the first gutter conduit, the first and second gutter conduits having at least one common wall of which at least a portion is removable, the portion when removed exposing a fluid flow connection between the two gutter conduits at such level and below the top of the retaining wall allowing water to flow from the first gutter conduit into the second gutter conduit whenever the water level on the first gutter conduit reaches the fluid flow connection, thereby inhibiting filling of the first gutter conduit appreciably above such level.

The term "conduit" as used herein is inclusive of open conduits or troughs as well as partially or wholly enclosed conduits.

In a preferred embodiment of the invention the conduits in the retaining wall are in vertical alignment, one above the other, and the upper conduit constitutes a water feed conduit about the perimeter of the swimming pool, for feed of fresh water into the pool, and the lower conduit constitutes a second gutter conduit. The conduits can also be in horizontal alignment, or at any angle thereto.

However, the upper conduit can also constitute a gutter conduit, as in the structures of U.S. Pat. Nos. 3,668,712, 3,668,713 and 3,668,714, and 4,050,104.

Preferred embodiments of the invention are illustrated in the drawings, in which.

Figure 1:
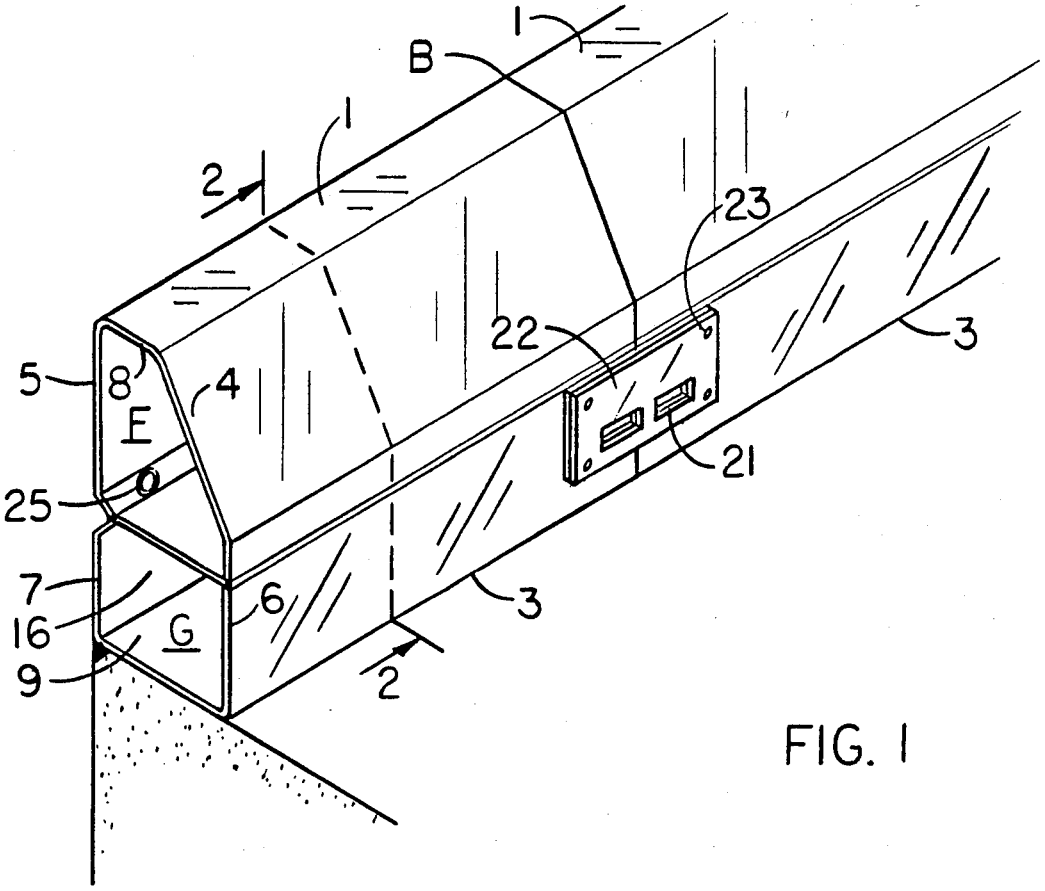
FIG. 1 represents an isometric view of one embodiment of perimeter skimming gutter retaining wall in accordance with the invention.
Figure 2:
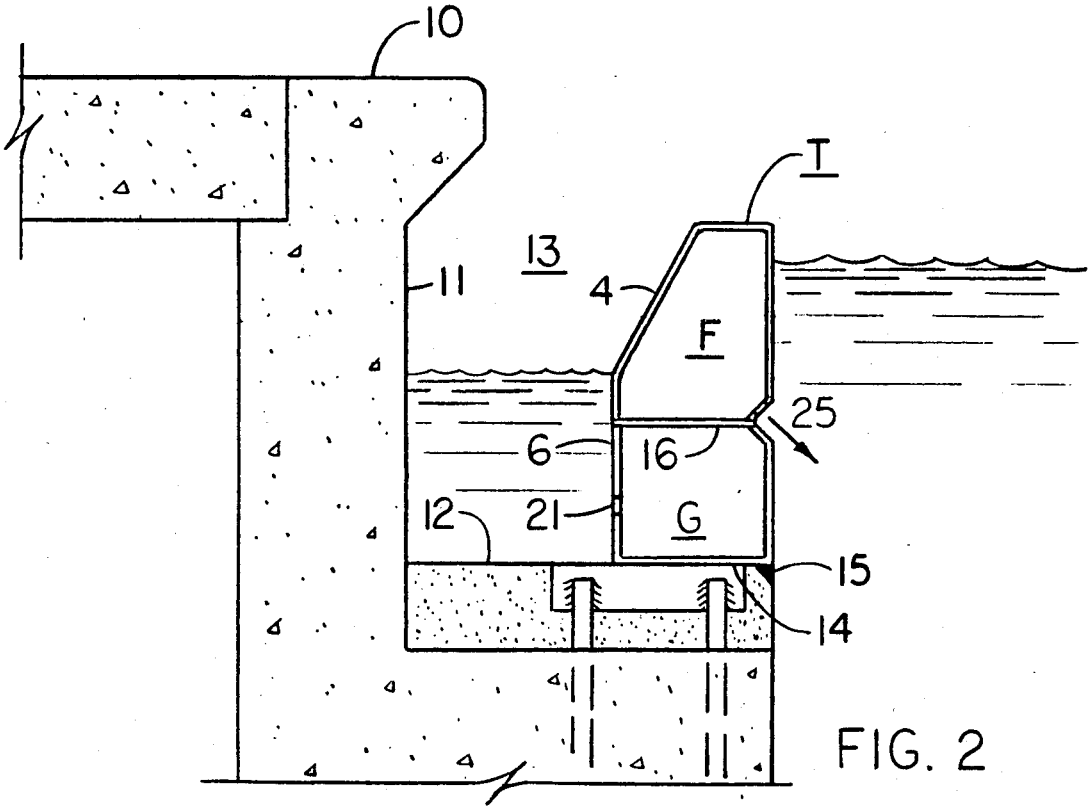
FIG. 2 represents an enlarged view in cross-section taken along the line 2—2 of FIG. 1.

The perimeter gutter retaining wall of FIGS. 1 and 2 is made of a number of modular units, which are assembled on-site and bonded together as at B by welding, soldering or brazing, to form a gutter retaining wall extending around substantially the entire circumference of the swimming pool. Each U-shaped unit 1 is made of stainless steel sheet, fored as a top for the retaining wall with standing sides 4,5 and a top 8. Each U-shaped unit 3 is made of stainless steel sheet, formed as a bottom 9 with standing sides 6,7. The sides 5,7 are designed to serve together as the pool retaining wall on the poolside of the gutter. The sides 4,6 serve together as the gutter wall on the gutter side of the retaining wall.

The coping 10 is made of concrete, cast in place during construction of the pool, and defines the outer wall 11 and bottom 12 of the gutter trough 13, the walls 4,6 of the retaining wall completing the trough. The bottom 12 also carries the retaining wall on the poolside end 14, which is sealed and anchored thereto by the grouting 15.

The U-shaped units 2,3 are linked together by welding, soldering or brazing to the separator plate 16 at the butt end of the standing sides 4, 5,6,7, thereof, on opposite sides of the plate. This is done in the shop, but can be done on-site, during construction of the pool. One welding, soldering or brazing operation will complete simultaneously the joint between the ends of sides 4, 6 and 16, and the ends of sides 5, 7 and 16, thus greatly facilitating assembly of the pool-side retaining wall. This is most easily done after the coping 10 and its bottom 12 are constructed in place, and can be done on bottom 12 as the final support.

Formed in the gutter-side retaining wall 6 is a plurality of elongated narrow, substantially horizontal slots 21, which are disposed at a level above the bottom 12 of the trough. The slots can be arranged in size and in number so at to provide for constant withdrawal of water from the gutter trough into the gutter conduit G in the wall, and this provides a surge capacity sufficient to accommodate the surge caused by swimmers without flooding the gutter trough, while at the same time providing an excellent wave-quelling effect (faster calming and faster wave subsidence) because of access to the gutter trough over the top T of the retaining wall. The slots can be at any level above the bottom of the gutter, lower or higher than the level shown.

In the embodiment shown, the open area presented by these slots constitutes 1% of the gutter length at the water level, but this open area can be from 1 to 75% of the gutter length at the water level.

FIG. 2 shows the normal water level of a pool in which this perimeter gutter retaining wall is installed. The limiting level is defined by the top T of the retaining wall. The top provides skimming action over any range of water circulating flow, when the water reaches this level, as, for example, with swimmers in the pool.

As shown in FIG. 2 water enters the first gutter trough 13 over the top T, and then enters the second gutter conduit G via the slots 21, and is drawn into the water recirculating system by pump suction (not shown), passing through the pool water recirculating system to the filter and the pump (not shown, but of conventional design), whence the water is returned to the pool by way of the upper water feed conduit F, and enters the pool via jets 25. Dirt of a size that can enter the slots 21 is thereby carried away from the gutter trough, and removed by the filter. The slots 21 are close enough to the end of the modular section and large enough to afford visual inspection of the integrity of the bond at that end to the next modular section.

The gutter trough is sized to provide a reserve pool water surge capacity, to accommodate the surge created when swimmers enter the pool. Even though in the event of such a surge the gutter level may initially rise above the row of slots 21, it will be apparent that if the flow into the gutter is normally less than the capacity of the slot system, the water level in the gutter will gradually be reduced to the level shown in FIG. 2.

The slots 21 can be arranged in size and in number so as to provide from 1% to 75% open area of the gutter perimeter at the gutter water level. The cover plate 22, which is adjustable by slide bolts 23, exposes as much or all of the slots' open area within this range as may be required for gutter flow capacity, and in-pool surge capacity sufficient to accommodate the surge caused by swimmers without flooding the gutter trough, while at the same time providing an excellent wave-quelling effect (faster calming and faster wave subsidence) because of access to the gutter trough over the top of the retaining wall of the gutter. The cover plate can be adjustable by any conventional means.

Figure 3:
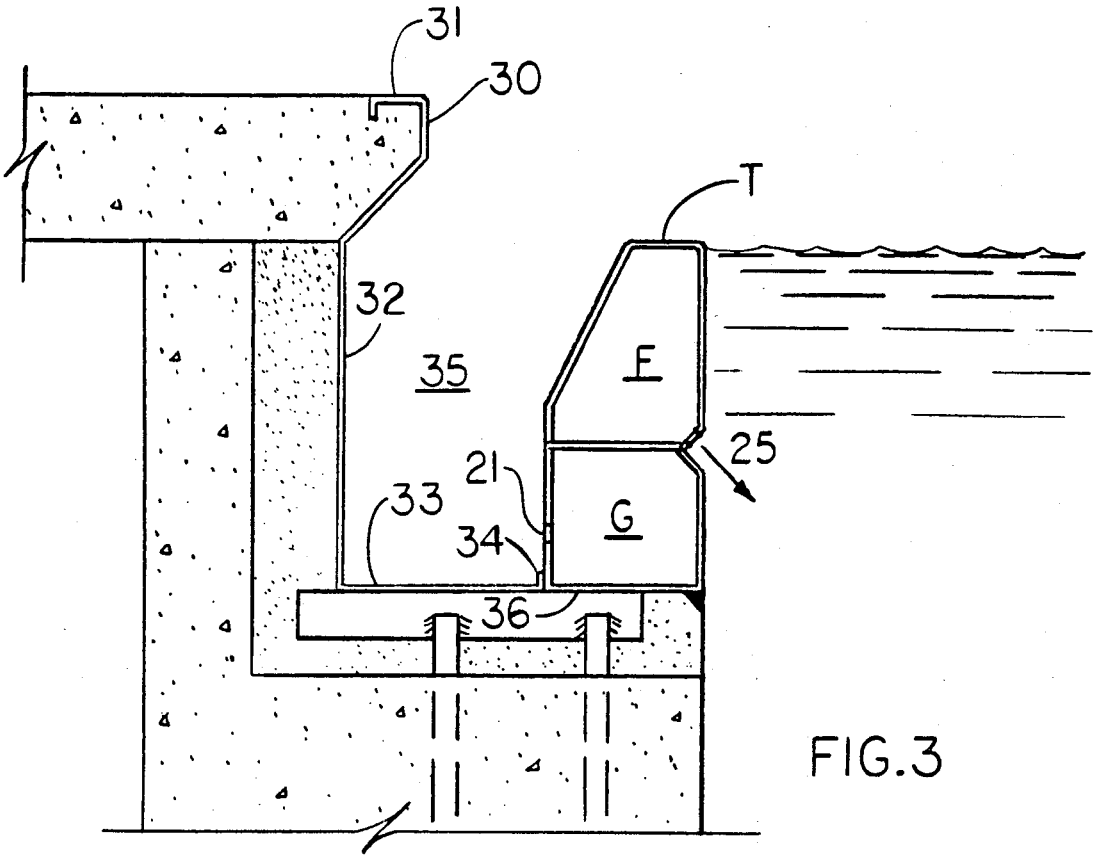
FIG. 3 represents a view in cross-section of a second embodiment of perimeter gutter in accordance with the invention, formed of shaped stainless steel sheet.

The gutter system shown in FIG. 3 is similar to that of FIGS. 1 and 2, except that the coping is made of stainless steel sheet 30 bent so as to form the top 31 of the coping; the outside wall 32 of the gutter 35 and the bottom 33 of the gutter 35. The end 34 is welded, brazed, or soldered to the bottom 35 of the second gutter conduit G.

Figure 4:
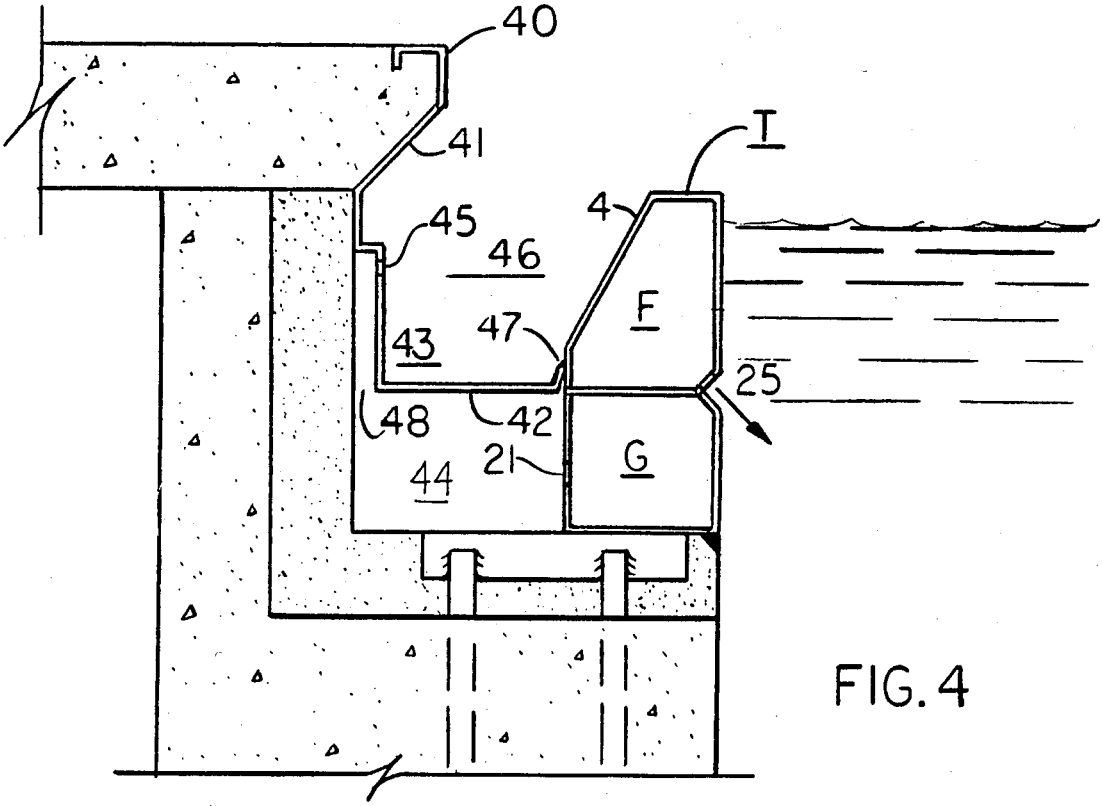
FIG. 4 represents a view in cross-section of a third embodiment of perimeter gutter in accordance with the invention, incorporating a trough constituting a first gutter conduit, with the second gutter conduit constituting the space below the trough and the lower conduit of the retaining wall.

The gutter system in FIG. 4 is similar to that of FIGS. 1 and 2, with the provision of a stainless steel coping 40 bent to form an upper side wall 41 of the gutter trough 46 and a divider 42 across the top of the trough. The divider is welded at 47 to the side wall 4 of the water feed conduit F, and separates the gutter trough into a relatively shallow top trough 43 only as deep as the water feed conduit F, and a lower portion 44 equal in depth to the second gutter conduit G. A plurality of transfer slots 45 in wall 41 at about two-thirds of the height of the trough 43 communicate via passage 48 with the lower portion 44, by overflow, while slots 21 communicate the lower portion 44 with the second gutter conduit G.

This perimeter gutter retaining wall is also made up of a number of modular gutter units which are fitted together about the perimeter of the pool during construction of the pool, the abutting ends being bonded together by welding, brazing or soldering as in FIGS. 1 and 2.

The skimming action of this gutter system is similar to that of FIGS. 1 and 2. The limiting water level in the pool is at the top T of the gutter retaining wall, and the water flow across the top T of the gutter retaining wall provides the skimming action, dirt being washed over the top into the gutter trough 43. Water in the trough 43 is fed back through the water-recirculation system to the filter pump, where it is cleaned, and then recirculated to the pool by way of the feed conduit F and inlets 25. The water inlet feed by way of the conduit F and the openings 25 provides a uniform distribution of fresh water throughout the perimeter of the pool, matching the skimming flow, which is equally uniform about the perimeter of the pool by way of the top of the gutter retaining wall.

In the event that the water level in the pool rises, due to swimmers entering the water, and also in the case of water surges or wave action, the flow of water across the top T of the gutter retaining wall is increased, and the amount of water in the gutter trough 43 rises. If the water level in the trough 43 reaches the slots 45 in the wall 41, flow then begins through the slots into the lower portion 44, and such flow prevents the water level in the trough 43 from rising further. The flow capacity of the slots is such that it is most unlikely, if not impossible, that the water level, in the gutter trough 43 will ever rise appreciably above this level, thus preventing flooding of the gutter, and also preventing any dirt in the gutter trough 43 from being washed back into the pool. Even if the flow capacity of the slots 45 is exceeded momentarily, there is still a reserve wall height between the slots and the top of the gutter retaining wall which will prevent flooding. While the water level is at the slots 45 the slots continue the skimming action of the top of the gutter retaining wall and the dirt washed over the top into the gutter trough 43 then proceeds through slots into the lower portion 44 and gutter conduit G, whence it is carried off via the suction gutter recirculation system to the filter, and removed, before the water is recirculated to the pool.

If desired, the divider 42 can be made removable, in which case the cmbined capacity of gutters 43,44 can be made into one gutter, merely by lifting out gutter divider 42. Now, all water crossing the top of the gutter enters the lower section 44 of the gutter, which can fill into the upper section as well before reaching the top T.

Figure 5:
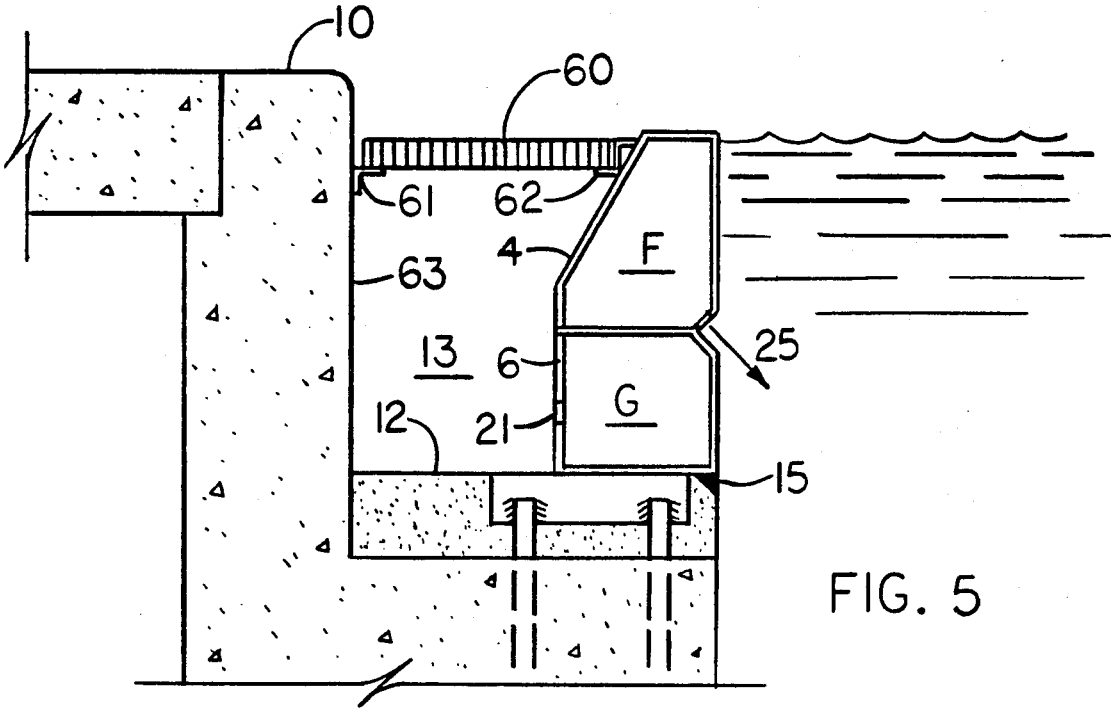
FIG. 5 represents a view in cross-section of another embodiment similar to FIG. 3 but including a grating over the first gutter trough and utilizing the upper conduit in the retaining wall as a water feed conduit and the lower conduit as a second gutter conduit.

The gutter system of FIG. 5 is similar to that of FIGS. 1 and 2, with the provision of a grating 60 removably supported on flanges 61, 62 on the outside gutter wall 63 and gutter-side conduit wall 4.

The perimeter gutter retaining walls shown in the drawings are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter of plastic material, either in whole or in part. There are plastics now available which are sufficiently strong to withstand the wear and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter, as shown in the embodiments of FIGS. 1 and 2 and 6.

The use of modular units, such as are shown in the drawings, is preferred, because this permits mass production of the gutter system at a point remote from the swimming pool, with easy and inexpensive transportation from that point to swimming pool construction sites anywhere in the world. The modular units can then be assembled on-site to form any type of configuration of swimming pool. The modular units can be made in straight sections for rectangular or other straight-sided pool shapes, while curved sections can be made for pear-shaped, elliptical, circular or other round-sided pool configurations.

The modular units can be fitted together by welding, soldering or brazing, in the case of metal units, by bonding, using various types of adhesives, in the case of metal or plastic units; or by heat-sealing, ultrasonic welding, or heat-bonding in the case of thermoplastic plastic units. Plastic units which are not fully heat-cured can be bonded and then cured in situ to form a permanent bond on site, in the course of construction of the pool.

The perimeter gutter system of the invention can be used completely around the pool perimeter, as desired. The most uniform skimming action and gutter action is of course obtained when the entire perimeter of the pool is provided with such a gutter.

While construction of the gutter in the form of modular units has been described, it will also be appreciated that the gutter system can be formed on-site in the configurations shown using concrete or plastic material, and can form an integral part of the pool wall, by casting or pouring into suitable frames, so that the material can harden and set in the desired pool shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a handmade gutter system on the pool site.

The gutter system can also be made from bricks or tiles, which are built up in the desired configuration. These can be the usual types of materials, preferably with a ceramic facing, so that it is leakproof, with the tiles being bonded together with water-resistant adhesive or cement.

The pool-side retaining wall as shown provides two separate conduits, of which either can be used for water feed or gutter flow, as desired. While in the embodiments shown in the drawings the upper is used as a water feed conduit, and the lower a gutter conduit, the upper can serve as a gutter conduit and the lower as a water feed conduit, as in U.S. Pat. Nos. 3,668,712, 3,668,713, and 3,668,714, and 4,050,104.

Moreover, if more than two conduits be desired, additional conduits can be separated out by introducing additional separator walls and intermediate H-wall sections.

The level of the drain openings with respect to the bottom of the gutter conduit can be adjustable, so as to provide adjustment of the water level permitted in the gutter before flow via the openings into the second gutter conduit commences. This adjustment can be provided for by forming the openings in the gutter-side retaining wall as vertical slots, or as slots at any angle to the vertical, or as a series of horizontal slots within an extended vertical height, and disposing a movable barrier member over the openings, with the opening or openings of the desired size and shape in the barrier member. Vertical or horizontal movement of the barrier member over the wall openings adjusts the relative open area of the opning or openings in the barrier member that are in register with the openings in the wall. There has to be a fluid-tight seal between the barrier member and the retaining wall, which can be provided for by a gasket or O-ring seal therebetween. The barrier member can move along slots with set screws fixing it at the desired skimmer opening and thus pool level, or by any other conventional means.

The openings can be of any desired size and shape providing a sufficient drain action. Preferably, they are elongated and substantially horizontal, but they can be vertical or at any angle in between. They also should limit flow to prevent surges and waves from entering, and hence are narrow. They should not exceed about one inch in height and should have a length to height ratio of from 1:1 to 100:1, although the latter limit is not critical. The limit is actually imposed only by the feasible length of gutter section and the strength of the material used for the retaining wall.

The swimming pool can be equipped with water filtration and cleaning recirculation systems. The gutters usually feed water therein to such systems by gravity. Pumps can be provided, and the gutters can also be provided with jet water inlets to direct a driving flow or water along the gutters, to flush out the gutters, and to drive water along the gutter towards the water recirculation system. Such jet water inlets are described in U.S. Pat. No. 2,932,397 to Ogden, dated Apr. 2, 1960.

Having regard to the foregoing disclosure, the following is claimed as the inventive and patentable embodiments thereof:

1. A modular bonded perimeter skimming gutter retaining wall for swimming pools, for construction by simple bonding together of a plurality of modular units on-site, disposed about the perimeter of a swimming pool as the retaining wall of the swimming pool, defining a pool-side wall of an open gutter conduit adapted to carry water at a level below a predetermined level of water in the swimming pool, over the top of which wall water may flow from the pool into the gutter, the retaining wall comprising two generally U-shaped channels open along one side and having open interiors defined by side walls extending from a common base, the channels being arranged with the open sides facing one another and bonded together together along the end faces of the side walls to a common divider plate closing off each channel and the interior spaces thereof, thereby forming separated conduits of each channel, one of said conduits being adapted to carry clean water feed to the pool and the other of said conduits being adapted to carry gutter water away from the pool, and a port in at least one of said conduits sufficiently close to a bonded end thereof to afford visual inspection of the integrity of the bond within the conduit at said bonded end.

2. A perimeter skimming gutter retaining wall for swimming pools in accordance with claim 1 in which the two conduits are in vertical alignment, one above the other, and the upper conduit is a clean water feed conduit for feeding clean water into the pool at a point below the top of the retaining wall.

3. A perimeter skimming gutter retaining wall in accordance with claim 1 in which the two conduits are in vertical aligment, one above the other, and the lower conduit is the clean water feed conduit for feeding clean water into the pool at a point below the top of the retaining wall.

4. A perimeter skimming gutter retaining wall in accordance with claim 1, comprising an open grid extending over the open gutter conduit.

5. A perimeter skimming gutter retaining wall in accordance with claim 1, in the form of a modular unit adapted to be assembled end-to-end with other such units to form the perimeter gutter retaining wall of a swimming pool.

6. A perimeter skimming gutter retaining wall in accordance with claim 5, comprising an outer retaining wall and a bottom wall for the open gutter conduit defined by sheet formed in the shape of said walls and bonded to the retaining wall.

7. A perimeter skimming gutter retaining wall in accordance with claim 6 in which the sheet also forms the perimeter top coping of the swimming pool.

8. A swimming pool comprising side walls and a bottom adapted to retain water therewithin, and, extending about the upper perimeter of at least a portion of one side wall thereof, a perimeter skimming gutter retaining wall in accordance with claim 1.

9. A swimming pool in accordance with claim 8 including a water cleaning and recirculating system for collecting water flowing into and along the gutter conduit, cleaning it, and returning it to the pool.

10. A perimeter skimming gutter retaining wall for swimming pools in accordance with claim 1, comprising an overflow outlet leading from the open gutter conduit to one of the two conduits in the retaining wall through a common wall therebetween.

11. A swimming pool comprising side walls and a bottom adapted to retain water therewithin, and extending about the upper perimeter of at least a portion of one side wall thereof, a perimeter skimming gutter retaining wall in accordance with claim 10.

12. A perimeter skimming gutter retaining wall for swimming pools in accordance with claim 10, comprising means for adjusting the height of the outlet with respect to the water level in the open gutter conduit.

13. A swimming pool comprising side walls and a bottom adapted to retain water therewithin, and, extending about the upper perimeter of at least a portion of one side wall thereof, a perimeter skimming gutter retaining wall in accordance with claim 12.

14. A perimeter skimming gutter retaining wall in accordance with claim 1, comprising a fluid flow communication between the open gutter conduit and one of the gutter conduits in the retaining wall, such fluid flow communication entering the gutter conduit at a level below the top of the retaining wall and adapted to drain off water from the open gutter conduit at any level exceeding a predetermined level therein, so as to inhibit the level of water in the open gutter conduit from ever reaching the top of the retaining wall.

15. A perimeter gutter retaining wall in accordance with claim 1, comprising a fluid flow communication between the open gutter conduit and at least one of the swimming pool and one of the conduits in the retaining wall, such fluid flow communication being at a level below the top of the retaining wall.

16. A perimeter skimming gutter retaining wall in accordance with claim 1, in which one of the conduits is within the retaining wall at a level equal to or below the open gutter conduit and in fluid flow connection therewith, such fluid connection entering the open gutter conduit at a level below the top of the retaining wall, and adapted to drain off water from the open gutter conduit at any level exceeding a predetermined maximum level therein, so as to inhibit the level of water in the open gutter conduit from reaching the top of the retaining wall, the open gutter conduit and conduit in the retaining wall having at least one side wall in common therebetween, separating available space of the open gutter conduit of which common side wall at least a portion is supported in open channel members, so that it can be lifted out.

17. A modular bonded perimeter skimming gutter retaining wall for swimming pools, for construction by simple bonding together end-to-end of a plurality of modular units on-site, disposed about the perimeter of a swimming pool as the retaining wall of the swimming pool, defining a pool-side wall of an open gutter conduit adapted to carry water at a level below a predetermined level of water in the swimming pool, over the top of which wall water may flow from the pool into the gutter, the retaining wall comprising two conduits in vertical alignment, one above the other, one of said conduits being adapted to carry clean water feed to the pool and the other of said conduits being adapted to carry gutter water away from the pool; and a port in at least one of said conduits sufficiently close to a bonded end thereof to afford visual inspection of the integrity of the bond within the conduit at said bonded end.

18. A perimeter skimming gutter retaining wall for swimming pools in accordance with claim 17 in which the upper conduit is a clean water feed conduit for feeding clean water into the pool at a point below the top of the retaining wall.

19. A perimeter skimming gutter retaining wall for swimming pools in accordance with claim 17 in which the lower conduit is a clean water feed conduit for feeding clean water into the pool at a point below the top of the retaining wall.

20. A perimeter skimming gutter retaining wall for swimming pools in accordance with claim 18 in which the port is an overflow outlet leading from the open gutter conduit to one of the two conduits in the retaining wall through a common wall therebetween.

21. A swimming pool comprising side walls and a bottom adapted to retain water therewithin, and extending about the upper perimeter of at least a portion of one side wall thereof, a perimeter skimming gutter retaining wall in accordance with claim 17.

22. A swimming pool comprising side walls and a bottom adapted to retain water therewithin, and, extending about the upper perimeter of at least a portion of one side wall thereof, a perimeter skimming gutter retaining wall in accordance with claim 20.

* * * * *